United States Patent [19]

Shibuya

[11] 4,289,453

[45] Sep. 15, 1981

[54] SWASH-PLATE TYPE COMPRESSOR

[75] Inventor: Tsunenori Shibuya, Higashi-Matsuyama, Japan

[73] Assignee: Diesel Kiki Co., Ltd., Tokyo, Japan

[21] Appl. No.: 24,679

[22] Filed: Mar. 28, 1979

[30] Foreign Application Priority Data

Apr. 8, 1978 [JP] Japan ..... 53/46292[U]

[51] Int. Cl.[3] ..... F04B 1/16

[52] U.S. Cl. ..... 417/269

[58] Field of Search ..... 417/269, 437

[56] References Cited

U.S. PATENT DOCUMENTS

| | | | |
|---|---|---|---|
| 3,695,786 | 10/1972 | Gannaway | 417/437 |
| 3,749,523 | 7/1973 | Wahl, Jr. | 417/269 |
| 3,801,227 | 4/1974 | Nakayama | 417/269 |

FOREIGN PATENT DOCUMENTS

| | | | |
|---|---|---|---|
| 2922307 | 5/1979 | Fed. Rep. of Germany | 417/269 |
| 52-36312 | 3/1977 | Japan | 417/269 |
| 52-18208 | 10/1977 | Japan | 417/269 |

*Primary Examiner*—William L. Freeh

*Attorney, Agent, or Firm*—Frishauf, Holtz, Goodman & Woodward

[57] ABSTRACT

A swash-plate type compressor of the type having combined cylinder blocks constituting the outer frame of the compressor and formed with a plurality of axially extending internal spaces one of which is used for storing lubrication oil, comprises a generally concave partition wall of a U-shaped cross section dividing the oil storing space into an upper chamber for receiving an outer fringe of the swash plate and a lower chamber for storing oil, in the combined cylinder blocks—partition wall has a first conduit formed therein at a level lower than the oil surface level in the upper chamber which is an elevated level obtained due to a to-and-fro movement of the swash plate after the compressor starts until the compressor reaches a predetermined rotational speed and also at a level higher than the oil surface level in the upper chamber which is obtained after the compressor reaches said predetermined rotational speed, and a second conduit formed therein and positioned at a lower level than an oil surface level in said lower chamber, said conduits providing communication between the upper and lower chambers, thus assuring supply of a proper quantity of lubrication oil to the sliding machine parts of the compressor. There is also provided means for prevention of metal powder and like substances from getting into said upper chamber.

3 Claims, 9 Drawing Figures

SWASH-PLATE TYPE COMPRESSOR

FIELD OF THE INVENTION

The present invention relates to a compressor, and more particularly to improvements in or to a swash-plate type compressor which is provided with a splash lubrication means.

A swash-plate type compressor typical of the conventional art is constructed such that a swash plate is mounted within the compressor housing for rotation in unison with a drive shaft also rotatably mounted within said housing. The swash plate has an outer fringe thereof immersed in the oil accumulated at the bottom of the housing, so that the swash plate being rotated splashes the oil into a misty state to feed it to the sliding machine parts in the housing, for carrying out lubrication of these parts. However, according to such conventional arrangement, the swash plate has its outer fringe deeply immersed in the oil at the bottom of the housing. Consequently, an excessive quantity of oily mist is often supplied to the sliding machine parts, and there occurs a leakage of the oil into the refrigerating circuit, resulting in large loss of oil. In addition, the above-mentioned arrangement forces part of the rotating energy supplied by the drive shaft to be used for stirring of the oil at the housing bottom through the swash plate, thus resulting in loss of the energy supplied by the drive shaft.

While, according to U.S. Pat. No. 3,801,227, there is provided a partition plate having a dish-like configuration in the compressor housing, which provides two partitioned chambers in the housing, one receptive of the fringe portion of the swash plate, and the other forming an oil reservoir. The partition wall has a side wall portion thereof formed with conduits for allowing the oil in the swash plate chamber to escape therethrough. However, according to this structure, the oil escape conduits are located at a higher level than the surface of the oil in the oil reservoir, so that a limited quantity of lubrication oil can flow into the swash plate chamber through the oil escape conduits. Consequently, the bearing portions for the drive shaft and other sliding machine parts in the compressor housing are not adequately lubricated.

OBJECTS OF THE INVENTION

It is an object of the invention to provide a swash-plate type compressor including a lubricating system which is capable of feeding an adequate quantity of lubrication oil in the form of a mist to the sliding machine parts in the compressor housing at the time of starting of the compressor, and allowing a minimum quantity of lubrication oil required, to be fed into the swash plate chamber, during the operation of the compressor, so as to keep to a minimum the area of contact of the swash plate with the oil, thus minimizing the energy to be consumed in stirring the oil through the swash plate.

It is another object of the invention to provide a swash-plate type compressor including a lubricating system which can prevent metal powder or like substances from getting mixed into the misty oil in the swash plate chamber.

Other and further objects, features and advantages of the invention will appear more fully from the following description.

SUMMARY OF THE INVENTION

According to the present invention, a swash-plate type compressor comprises a pair of horizontal cylinder blocks, combined together in an axial alignment, a drive shaft penetrating the cylinder blocks along axes thereof for rotation relative to the cylinder blocks, and a swash plate secured to the drive shaft, the combined cylinder blocks including a plurality of cylinder bores extending through the cylinder blocks axially thereof, each receiving a piston for sliding therein, and a plurality of cylinder bores extending through the cylinder blocks axially thereof, each receiving a piston for sliding therein, and a plurality of internal spaces axially defined between adjacent cylinder bores, the swash plate having an outer fringe thereof disposed in engagement with the piston to rotate in unison with the drive shaft being rotated, for causing reciprocal motion of the piston within the cylinder bore to carry out a pumping action. The improvement of the invention comprises a partition wall located in the lowermost of the internal spaces, the partition wall having a generally concave configuration and dividing the lowermost internal space into an upper chamber for receiving at least an outer fringe portion of the swash plate, and a lower chamber for storing oil, the partition wall having at least a portion thereof positioned below an oil surface level in the lower chamber, the partition wall having at least one first conduit formed therein and which is positioned at a level lower than the oil surface level in the upper chamber which is an elevated level obtained due to a to-and-fro movement of the swash plate after the compressor starts until the compressor reaches a predetermined rotational speed and also at a level higher than the oil surface level in the upper chamber which is obtained after the compressor reaches said predetermined rotational speed, the at least one first conduit providing communication between the lower and upper chambers, the partition wall also having at least one second conduit formed therein and positioned at a lower level than an oil surface level in the lower chamber to provide further communication between the upper and lower chambers, the at least one second conduit having such a diameter as to allow oil to flow through the second conduit at a minimum flow rate required, whereby the first conduit acts as an oil spill port and the second conduit as an oil feeding port.

DETAILED DESCRIPTION OF THE INVENTION

Figure 1:
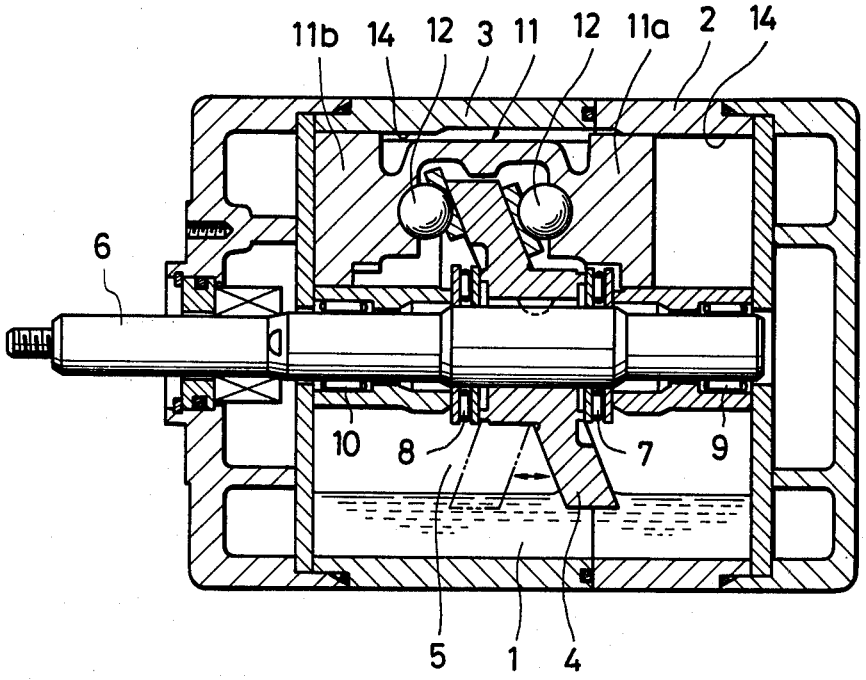
FIG. 1 PRIOR ART
FIG. 1 is a longitudinal sectional view of a conventional swash-plate type compressor.

Referring to FIG. 1, a conventional swash-plate type compressor is shown. According to the illustrated arrangement, the oil accumulated in the oil reservoir 1 provided downward of the cylinder blocks 2, 3 is splashed up by the swash plate 4 being rotated within the swash-plate chamber 5 by the rotating drive shaft 6, into a misty state. The mist thus formed is led to the thrust bearings 7, 8, the radial bearings 9, 10, the piston 11 and the ball bearings 12 etc. for lubrication of these parts.

The positional relationship between the swash plate 4 and the oil in the oil reservoir 1 is such that the swash plate 4 has an outer fringe thereof deeply immersed in the oil, providing a large area of contact between the swash plate 4 and the oil. Thus, a great deal of oil is splashed up by the rotation of the swash plate 4 so that too much oily mist is led to the above-mentioned parts. As a consequence, oil leaks into the refrigerating circuit through gaps between the heads 11*a*, 11*b* of the piston 11 and the cylinder bores 14 and between the drive shaft 6 and the radial bearings 9, 10, resulting in large consumption of the oil. Furthermore, part of the rotating energy of the drive shaft 6 is spent as oil stirring energy through the swash plate 4, thus inviting large energy loss.

Figure 2:
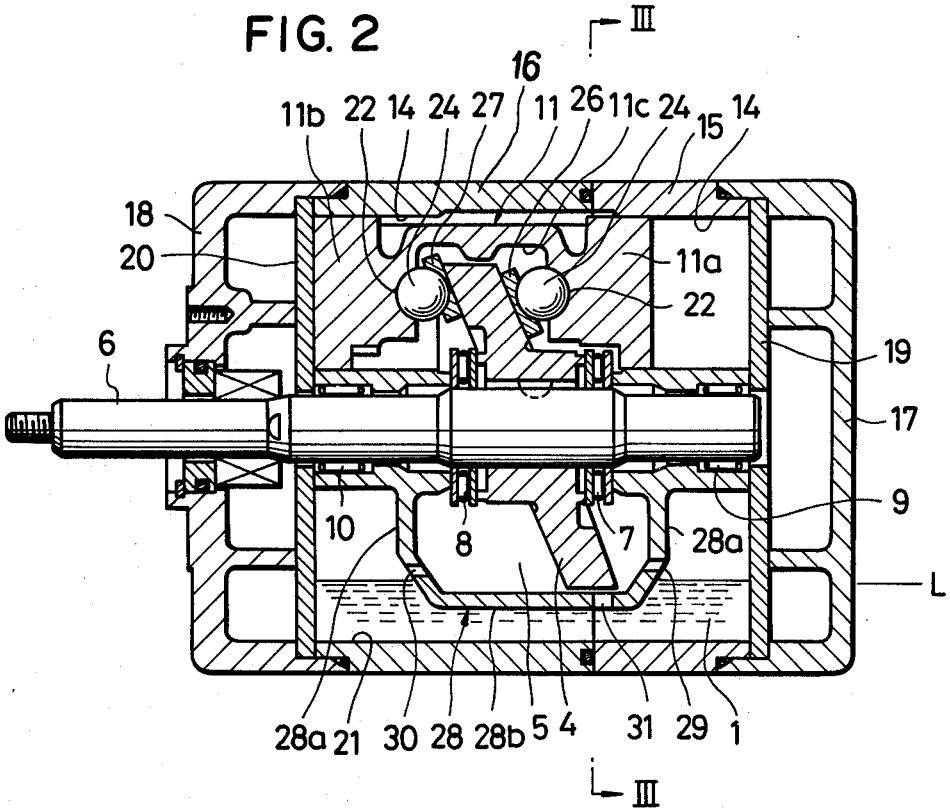
FIG. 2 is a longitudinal sectional view of the swash-plate type compressor according to an embodiment of the present invention.
Figure 3:
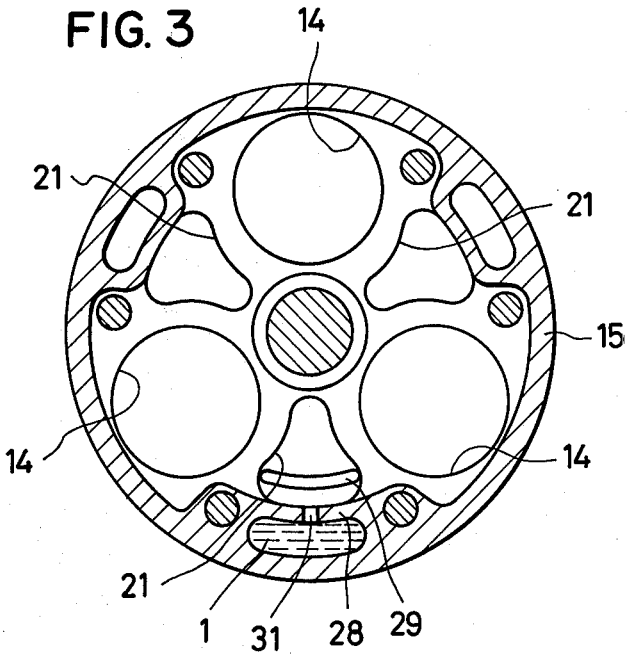
FIG. 3 is a sectional view taken along the line III—III in FIG. 2, with the pistons and the swash plate omitted.

FIG. 2 and FIG. 3 illustrate a swash-plate type compressor, in a preferred embodiment, according to the invention. A pair of cylinder blocks 15, 16 are horizontally disposed and combined with each other in an axial alignment. A drive shaft 6 axially penetrates these combined cylinder blocks 15, 16 for rotation about its own axis via radial bearings 9, 10. A swash plate 4 is secured to the drive shaft 6 for rotation in unison with the drive shaft 6 via thrust bearings 7, 8 interposed between the central portion of the swash plate 4 and the cylinder blocks 15, 16.

A rear cylinder head 17 and a front cylinder head 18 are secured, respectively, to the left and right ends of the combined cylinder blocks 15, 16 with valve plates 19, 20 intervening between the heads 17, 18 and the cylinder blocks 15, 16.

As will be understood from the illustration of FIG. 3, each of the cylinder blocks 15, 16 has its interior formed with three cylinder bores 14 axially extending therethrough. Further formed between adjacent cylinder bores 14 are three chambers 21 also axially extending through the combined cylinder blocks 15, 16. Slidably inserted in said cylinder bores 14 are double acting pistons 11 which each have opposite ends thereof formed as piston heads 11*a*, 11*b* which are in close sliding contact with the inner wall of the cylinder bore 14. Thus, pump working chambers are defined by the end faces of the heads 11*a*, 11*b*, the inner wall of the cylinder bore 14 and the inner end walls of the valve plates 19, 20. An axially central portion of the piston 11 has an inner wall thereof formed as a recess 11*c*. Said recess 11*c* embraces the outer fringe of the swash plate 4 via bearing balls 24 received within pockets 22 formed in the recess 11*c*, and shoes 26, 27 disposed on the swash plate 4.

Under this arrangement, rotation of the swash plate 4 caused by rotation of the drive shaft 6 causes reciprocal motion of the piston 11 within the cylinder bore 14 for carrying out a pumping action in collaboration with suction valves and discharge valves (not illustrated) formed in the valve plates 19, 20.

Of the chambers 21 formed through the cylinder blocks 15, 16, the upper chambers are used for temporary storage of suction refrigerant and discharge refrigerant therein or allowing the refrigerant to pass therethrough, while the lowermost one 21 of the chambers stores oil accumulated therein as an oil reservoir.

Formed within this lowermost chamber 21 is a partition wall 28 which has a generally concave or dish-like shape of a U-shaped cross section and comprises vertical walls 28*a* radially downwardly extending from the inner wall of the chamber 21 and a bottom wall 28*b* horizontally extending between the vertical walls 28*a*. The interior of the chamber 21 is divided by this partition wall 28 into a lower chamber forming said oil reservoir 1 and an upper chamber 5 within which the outer fringe portion of the swash plate 1 is received. The partition wall 28 is formed with two conduits 29, 30 located at a higher level than the surface of the oil in the oil reservoir 1, that is, in the opposite end portions of the vertical walls 28*a* facing the valve plates 19, 20. These conduits 29, 30 establish communication between the upper swash-plate chamber 5 and the lower chamber or oil reservoir 1 to serve as spill ports for the oil in the chamber 5. The partition wall 28 also has a further similar conduit 31 at a lower level than the oil surface in the reservoir 1, that is, in the bottom wall 28*b* in the illustrated embodiment, which serves as an oil feeding port for feeding a suitable quantity of oil from the oil reservoir 1 to the swash plate 5 therethrough.

Figure 4:
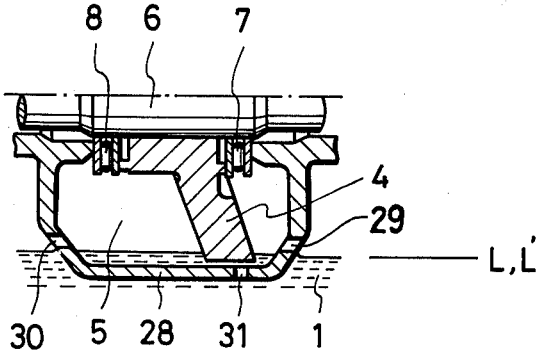
FIG. 4 is an enlarged sectional view of a portion of the compressor of the invention in a position before starting.
Figure 5:
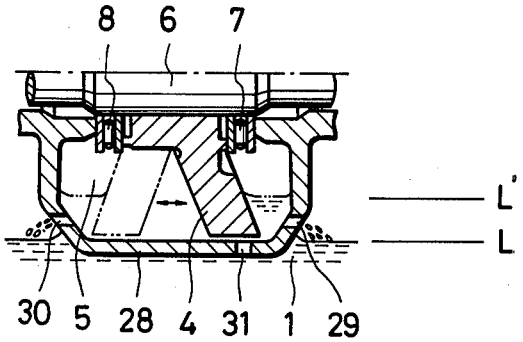
FIG. 5 is an enlarged sectional view of the same portion in a position just after starting.
Figure 6:
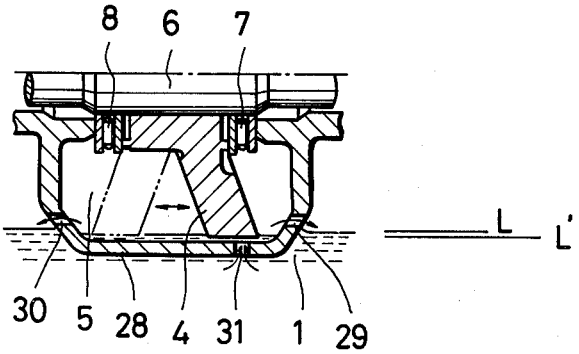
FIG. 6 is an enlarged sectional view of the same portion in its operating position.

FIG. 4 through FIG. 6 show the oil feeding operation of the lubricating mechanism of the swash-plate type compressor constructed as above.

Before starting of the compressor, communication is maintained between the swash-plate chamber 5 and the oil reservoir 1 by means of the oil feeding conduit 31 formed in the partition wall 28. Thus, the oil surface level L in the oil reservoir 1 coincides with the oil surface level L′ in the swash-plate chamber 5, as illustrated in FIG. 4.

At the starting of the compressor, rotation of the swash plate 4 causes to-and-fro motion of the outer fringe thereof so that the oil in the swash plate chamber 5 is pushed to and fro to cause elevation of the oil surface level L′. Accordingly, there occurs an increase in the area of contact of the swash plate 4 with the oil, so that a larger quantity of oil is splashed to promptly supply a larger quantity of oily mist to the sliding machine parts which carried almost no oil before the starting of the compressor.

Then, as the to-and-fro motion of the swash plate 4 is accelerated due to an increase in the rotational speed of the drive shaft 6, some of the oil in the swash-plate chamber 5 is returned to the oil reservoir 1 via the oil spill ports 29, 30 to decrease the quantity of oil staying in the chamber 5. Then, when the drive shaft 6 has reached a regular rotational speed of operation, the oil surface level L′ in the swash plate 4 lowers so as to slightly touch the lower end of the swash plate 4, as shown in FIG. 6. Since oil is constantly fed from the oil reservoir 1 to the swash-plate chamber 5 via the oil feeding conduit 31 at the minimum flow rate required, the oil surface level L′ in the swash-plate chamber 5 is maintained in slight contact with the lower end of the swash plate 4. Since the area of contact of the swash plate 4 with the oil is thus very small, an oily mist is not produced in a quantity in excess of the required quantity, thus leading to a curtailment in the oil consumption. Furthermore, since the quantity of oil stirred by the rotation of the swash plate 4 is thus decreased, the amount of energy to be lost for the oil stirring by the swash plate can be decreased.

Figure 7:
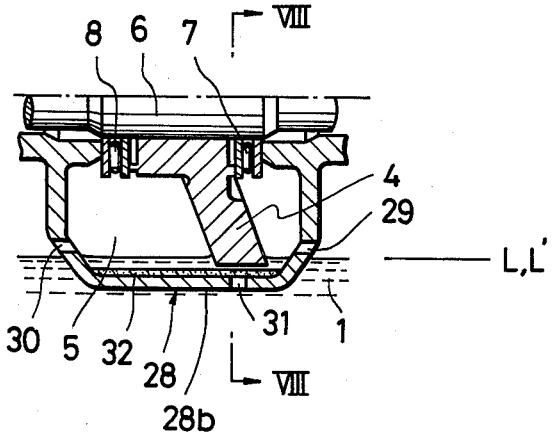
FIG. 7 is an enlarged sectional view of a portion of the compressor according to another embodiment of the invention.
Figure 8:
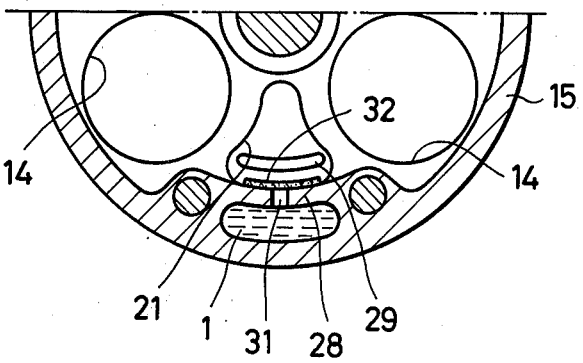
FIG. 8 is a sectional partial view taken along the line VIII—VIII in FIG. 7 with the swash plate omitted.

Referring to FIG. 7 and FIG. 8 illustrating another embodiment of the invention, a filter material 32 is laid over the bottom surface of the swash-plate chamber 5 so as to cover the oil feeding conduit 31. This filter material 32 prevents metal powder or like material in the oil reservoir 1 from getting mixed into the oily mist in the swash-plate chamber 5, thus enabling to avoid the phenomenon that metal powder and like material adhere to the lubrication surfaces of the sliding machine parts to cause seizure of these parts.

Figure 9:
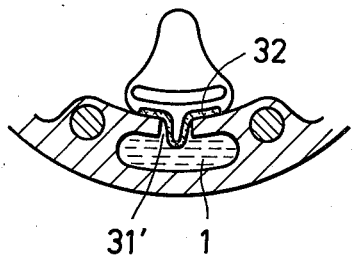
FIG. 9 is a sectional partial view of a modification of the embodiment of the invention shown in FIGS. 7 and 8.

Still further, if the filter material 32 is disposed with part thereof protruding into the oil in the oil reservoir 1 through the oil feeding conduit 31' of the partition wall 28 as illustrated in FIG. 9, the filter material 32 can be kept in an oil-permeated state and can feed oil into the chamber 5 due to the osmotic pressure, even in the event that the oil surface level in the oil reservoir 1 lowers down than a prescribed level. Thus, more perfect measures for prevention of seizure of the sliding machine parts or a like defect is provided. The filter material 32 may preferably be made of felt or urethane foam or like material. Also, the filter material 32 may be so disposed that the surface of the material 32 is always kept in contact with the associated outer fringe surface of the swash plate 4.

Having described specific embodiments of the invention, it is believed obvious that modification and variation of the invention is possible in light of the above teachings.

What is claimed is:

1. In a swash-plate type compressor having a pair of horizontal cylinder blocks, combined together in an axial alignment, a drive shaft penetrating said cylinder blocks along axes thereof for rotation relative to said cylinder blocks, and a swash plate secured to said drive shaft, said combined cylinder blocks including a plurality of cylinder bores extending through the cylinder blocks axially thereof, each receiving a piston for sliding therein, and a plurality of internal spaces axially defined between adjacent cylinder bores, wherein said swash plate has an outer fringe thereof disposed in engagement with the piston thereby to rotate in unison with the drive shaft being rotated, for causing reciprocal motion of the piston within the cylinder bore to carry out a pumping action, the improvement wherein:

the lowermost of said internal spaces is provided with a partition wall having a generally concave configuration and dividing the space into an upper chamber for receiving at least an outer fringe portion of the swash plate, and a lower chamber for storing oil, said partition wall having at least a portion thereof positioned below an oil surface level in said lower chamber, wherein said partition wall has at least one first conduit formed therein and which is positioned at a level lower than the oil surface level in the upper chamber which is an elevated level obtained due to a to-and-fro movement of the swash plate after the compressor starts until the compressor reaches a predetermined rotational speed and also at a level higher than the oil surface level in the upper chamber which is obtained after the compressor reaches said predetermined rotational speed, said at least one first conduit providing communication between said lower chamber and said upper chamber, said partition wall also having at least one second conduit formed therin and positioned at a lower level than an oil surface level in said lower chamber to provide further communication between said upper and lower chambers, said at least one second conduit having such a diameter as to allow oil to flow through said second conduit at a minimum flow rate required, whereby the first conduit acts as an oil spill port and the second conduit as an oil feeding port; and comprising a filter material disposed on an inner wall of said upper chamber in a lower portion of said upper chamber so as to cover said second conduit, said filter material straining off metal powder and the like material.

2. In a swash-plate type compressor having a pair of horizontal cylinder blocks, combined together in an axial alignment, a drive shaft penetrating said cylinder blocks along axes thereof for rotation relative to said cylinder blocks, and a swash plate secured to said drive shaft, said combined cylinder blocks including a plurality of cylinder bores extending through the cylinder blocks axially thereof, each receiving a piston for sliding therein, and a plurality of internal spaces axially defined between adjacent cylinder bores, wherein said swash plate has an outer fringe thereof disposed in engagement with the piston thereby to rotate in unison with the drive shaft being rotated, for causing reciprocal motion of the piston within the cylinder bore to carry out a pumping action, the improvement wherein:

the lowermost of said internal spaces is provided with a partition wall having a generally concave configuration and dividing the space into an upper chamber for receiving at least an outer fringe portion of the swash plate, and a lower chamber for storing oil, said partition wall having at least a portion thereof positioned below an oil surface level in said lower chamber, wherein said partition wall has at least one first conduit formed therein and which is positoned at a level lower than the oil surface level in the upper chamber which is an elevated level obtained due to a to-and-fro movement of the swash plate after the compressor starts until the compressor reaches a predetermined rotational speed and also at a level higher than the oil surface level in the upper chamber which is obtained after the compressor reaches said predetermined rotational speed, said at least one first conduit providing communication between said lower chamber and said upper chamber, said partition wall also having at least one second conduit formed therein and positioned at a lower level than an oil surface level in said lower chamber to provide further communication between said upper and lower chambers, said at least one second conduit having such a diameter as to allow oil to flow through said second conduit at a minimum flow rate required, whereby the first conduit acts as an oil spill port and the second conduit as an oil feeding port; and comprising a filter material disposed on an inner wall of said upper chamber in a lower portion of said upper chamber so as to cover said second conduit, said filter material straining off metal powder and like material;

said filter material having a portion thereof protruding into said lower chamber through said second conduit, said filter material serving to supply the upper chamber with oil due to osmotic pressure when the oil surface level in the lower chamber becomes lower than a predetermined oil surface level.

3. The swash-plate compressor as recited in claim 2, in which said partition wall comprises vertical walls and a bottom wall horizontally extending between said vertical walls, wherein the vertical walls have front and rear end faces facing axially of the cylinder blocks each formed with said first conduit, and said bottom wall is formed with said second conduit.

* * * * *